US007418810B2

(12) United States Patent
Barnes

(10) Patent No.: US 7,418,810 B2
(45) Date of Patent: Sep. 2, 2008

(54) EQUINE TRAINING HALTER

(76) Inventor: Billy M. Barnes, P.O. Box 97, Peggs, OK (US) 74452

( * ) Notice: Subject to any disclaimer, the term of this patent is extended or adjusted under 35 U.S.C. 154(b) by 352 days.

(21) Appl. No.: 11/377,145

(22) Filed: Mar. 16, 2006

(65) Prior Publication Data

US 2006/0156698 A1 Jul. 20, 2006

(51) Int. Cl.
*B68B 1/02* (2006.01)

(52) U.S. Cl. ..... 54/24

(58) Field of Classification Search ..... 54/6.1, 54/6.2, 13, 24, 85

See application file for complete search history.

(56) References Cited

U.S. PATENT DOCUMENTS

| | | | | | |
|---|---|---|---|---|---|
| 528,760 | A | * | 11/1894 | Casey | 54/24 |
| 1,115,788 | A | * | 11/1914 | Dance et al. | 54/24 |
| 3,401,500 | A | * | 9/1968 | Wright | 54/6.1 |
| 3,949,538 | A | | 4/1976 | Woodruff | |
| 3,998,033 | A | | 12/1976 | Watkins et al. | |
| 4,324,089 | A | | 4/1982 | Hart et al. | |
| 4,472,925 | A | | 9/1984 | Woodruff | |
| 4,565,055 | A | | 1/1986 | Simpson | |
| 5,660,031 | A | | 8/1997 | Clark | |
| 6,591,589 | B2 | | 7/2003 | Cook | |
| 2002/0148207 | A1 | | 10/2002 | Cook | |
| 2005/0034435 | A1 | | 2/2005 | Kemp et al. | |

FOREIGN PATENT DOCUMENTS

| | | |
|---|---|---|
| WO | WO 97/39977 | 10/1997 |

OTHER PUBLICATIONS

PCT Office, "Notification of Transmittal of International Search Report and Written Opinion," (Mar. 3, 2008).

* cited by examiner

*Primary Examiner*—Rob Swiatek
(74) *Attorney, Agent, or Firm*—Gable Gotwals

(57) ABSTRACT

An improved equine training halter includes a noseband and a headband. Left and right through openings are formed in the headband and located to receive therethrough the left and right ears, respectively, of an equine. Left and right lines are attached to the headband adjacent to its lower surface. Each line includes a hoop positioned substantially concentrically about one of the left and right through openings. A recoil mechanism is anchored to the central headband portion between the left and right through openings and is secured to the hoops of the left and right lines such that the hoops are pulled back to their original position when the lines are released after being pulled to apply pressure to areas of sensitivity around the equine's ears.

9 Claims, 2 Drawing Sheets

EQUINE TRAINING HALTER

FIELD OF THE INVENTION

The present invention relates generally to equine training devices. More specifically, the present invention is directed toward an equine training halter uniquely configured to efficiently and effectively control equine behavior.

BACKGROUND OF THE INVENTION

Many different types of halters have been used to control and direct the behavior of equines such as horses. Some halters use a bit positioned across the back of the equine's mouth to apply behavior-inducing pressure to the mouth of the equine. The mouth is one of the most sensitive areas of the equine's head, and halters with bits take advantage of this sensitivity to control the equine's behavior. When the rider wants the equine to turn either left or right, the rider can pull on the corresponding rein. This causes the bit in the equine's mouth to move backwards against the lip, gum and tongue of the corresponding side of the equine's mouth. The equine will then turn its head in reaction to the pressure exerted by the bit. Likewise, if the rider wants the equine to stop, the rider can pull back on both rings, which causes the bit to ride up and into the equine's mouth against the tongue and on both sides of the equine's lips and gums causing the equine to move its head backward and to slow down or stop.

While a bit can be a very effective tool in controlling an equine, over use of the bit or excessive force applied by the bit can result in damaged or bruised gums, lips and tongue of the equine's mouth. If the excessive force is severe it can render the equine's mouth too sore and sensitive to use the bit. In addition, some equines will not tolerate having the bit placed in their mouth.

Other halters rely on the application of behavior-inducing pressure to other pressure sensitive areas of the equine's head, such as the poll and behind the ears. U.S. Pat. No. 5,660,031, for example, discloses a horse training apparatus which employs pressure beads connected to a cord for applying pressure behind the ears of the horse. Such devices are only marginally effective, however, owing to an inability to consistently position the pressure beads at the precise area of acuity/sensitivity. It would be desirable to have an equine training halter configured in such a way as to reduce or eliminate the potential for improper positioning of pressuring inducing elements of the halter.

BRIEF SUMMARY OF THE INVENTION

The present invention achieves its objections by providing an equine training harness with a noseband and a headband. The noseband is sized to fit around the head of an equine just above its mouth. The headband has an upper surface and an opposing lower surface and a left and right cheek strap secured to the noseband. There is a left through opening and a right through opening which pass through the headband and are located to receive the left and right ears respectively of an equine. A left line and a right line are attached to the headband adjacent to the lower surface. Each line has a hoop positioned substantially concentrically about the through opening on their respective side. The left line and the right line pass through a first and second pulley respectively which are attached to the noseband. A recoil mechanism is anchored to the central headband portion between the left and right through holes. The recoil mechanism is also secured to the hoops of the left and right lines such that it pulls the hoops back to their original position when the lines are released after being pulled to put pressure on the equine's ears.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
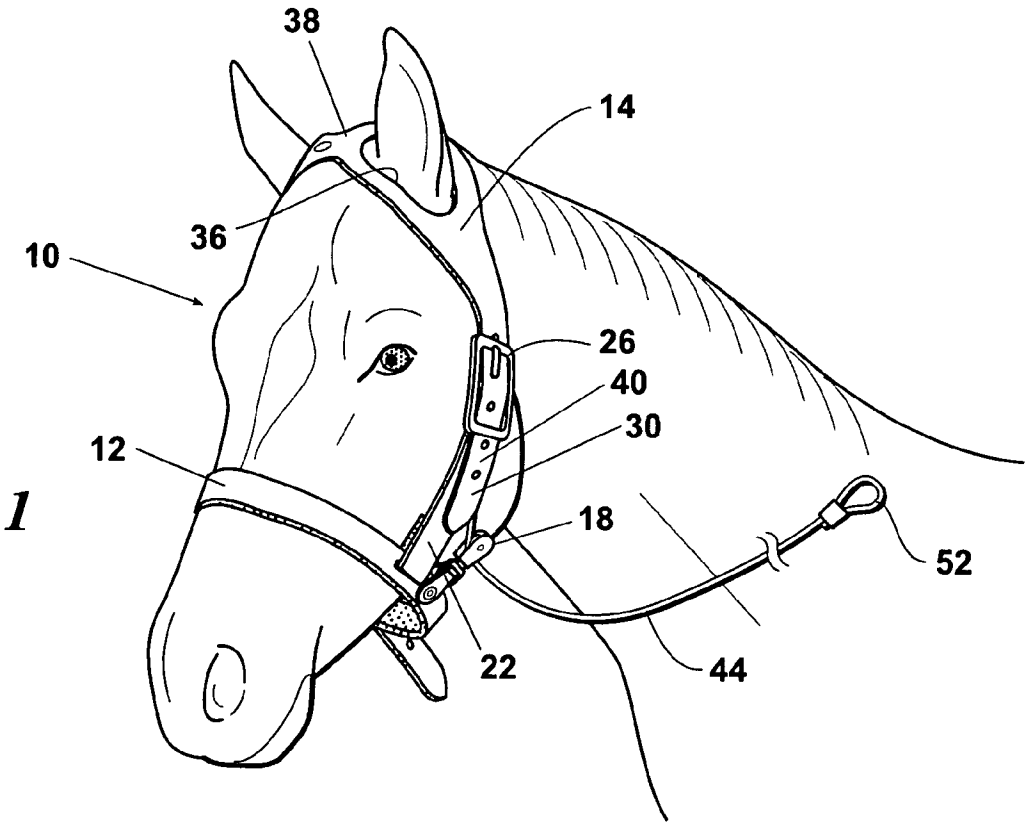
FIG. 1 is a perspective view of an equine wearing the halter of the present invention.

Turning now to the drawings, FIGS. 1 through 4 show the improved training harness of the present invention in use as well the individual pieces that make up the harness. The improved training harness 10 has a noseband 12 and a headband 14. The length of the noseband 12 is sufficient to encircle the head of the equine just above the mouth. The noseband 12 is secured around the head of the equine by a buckle 16. There are also a first and second pulley 18 and 20 attached to the noseband 12. A first and second strap 22 and 24 extend perpendicular from the noseband 12. First and second buckles 26 and 28 are attached to the distal ends of the first and second straps 22 and 24.

Figure 2:
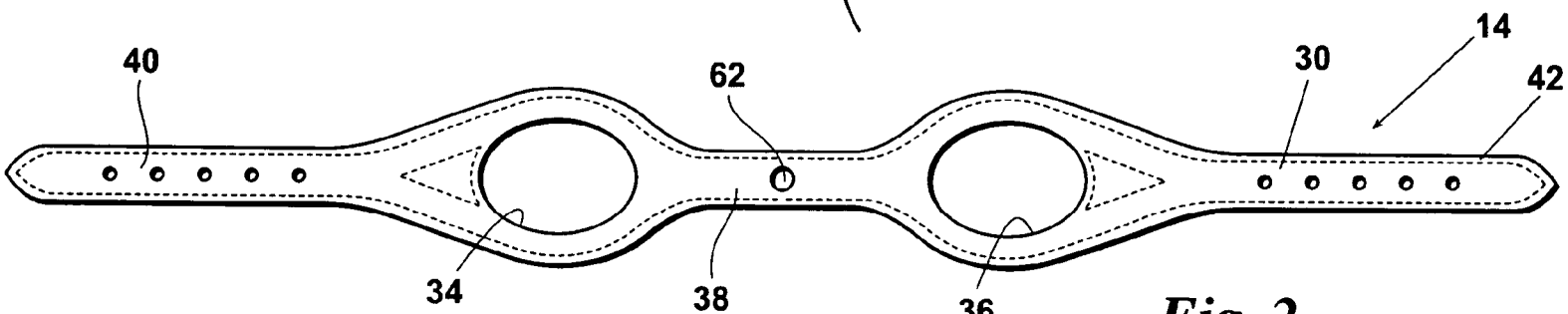
FIG. 2 is a top view of the headband.
Figure 3:
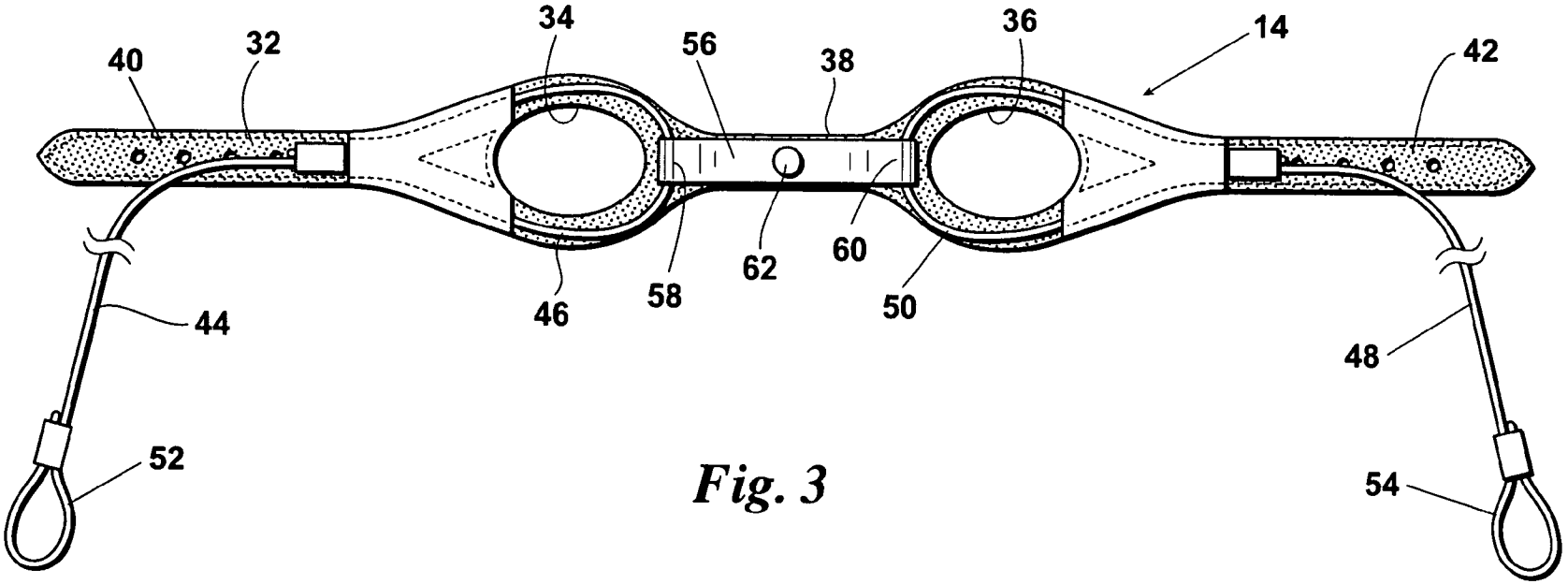
FIG. 3 is a bottom view of the headband.
Figure 4:
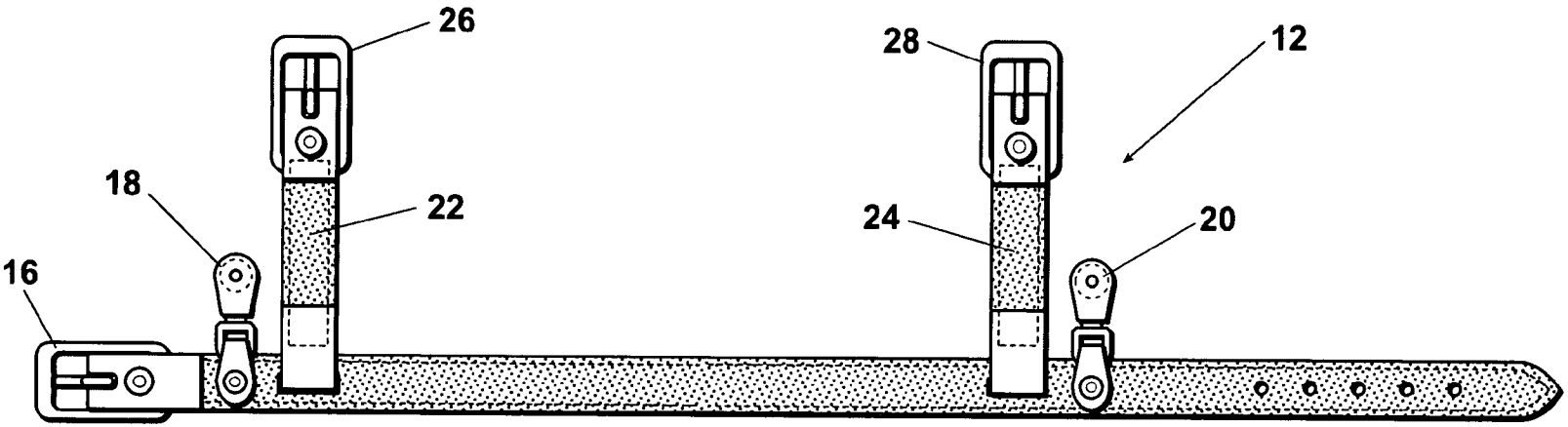
FIG. 4 is a top view of the noseband.

The headband 14 has an upper surface 30 as shown in FIG. 2 and a lower surface 32 which is best seen in FIG. 3. There is a left and right through opening 34 and 36 located to receive the corresponding left and right ears of the equine when the harness is placed on the equine's head. The central headband portion 38 is located on the headband 14 between the left through opening 34 and the right through opening 36.

When the improved training harness 10 is placed on an equine. The central headband portion 38 rides across and back of the head of the equine.

The headband 14 also has a left cheek strap 40 and a right cheek strap 42. When the harness 10 is placed on the equine, the left cheek strap 40 runs along the side the left cheek of the equine and is secured to the noseband 12. The right cheek strap 42 extends along the right cheek of the equine and is likewise secured to the noseband 12. There is a left line 44 attached adjacent to the lower surface 32 of the headband 14. The left line 44 has a hoop 46 positioned substantially concentrically about the left through opening 34 of the headband 14. There is also a right line 48 secured to the lower surface 32 of the headband 14. The right line 48 has a hoop 50 which is positioned substantially concentrically about the right through opening 36 of the headband 14. With the improved training harness 10 placed on an equine, the left line 44 extends underneath the left cheek strap 40 down through the first pulley 18. A loop 52 is located on the opposite end of the left line 44. The loop 52 can be used to secure the left line 44 to the reins.

Likewise the right line 48 extends along and underneath the right cheek strap 42 and passes through the second pulley 20. The right line 48 has a loop 54 which can be used to secure the right line 48 to the reins.

A recoil mechanism 56 with a left hoop 58 and a right hoop 60 is secured to the central headband portion 38 as best seen in FIG. 3. The recoil mechanism moves the left and the right hoops 46 and 50 away from the equine's ears when the trainer releases the reins.

The left hoop 58 of the recoil mechanism 56 is interlocked with the hoop 46 of the left line 44. Likewise, the right hoop 60 of the recoil mechanism 56 interlocks with the hoop 50 of the right line 48. The center of the resilient strap is secured to the central headband portion 38 of the headband 14 by a rivet 62.

While the improved training harness 10 shown in the drawings has a recoil mechanism 56 constructed from a strap of resilient material and secured to the central headband portion 38 by a rivet 62, it would be obvious to those skilled in the art to construct the recoil mechanism 56 out of other materials and anchor it in any other manner commonly known in the art.

When the improved training harness 10 is in use the headband 14 is secured via to the left cheek and right cheek straps 40 and 42 to the first and second straps 22 and 24 respectively of the noseband 12. The central headband portion 38 is placed behind the head of the equine and the left ear is passed through the left through opening 34 and hoop 46 of the left line 44. The right ear of the equine is passed through the right through opening 36 and hoop 50 of the right line 48. The noseband 12 is then wrapped around the head of the equine just above its mouth and secured by the buckle 16 or other means commonly known in the art. The reins can then be attached to the loops 52 and 54 of the left and right lines 44 an 48. The trainer or rider can then control the equine by pulling on the reins. This causes the left and right lines 44 and 48 to be pulled downward which in turn causes the left and right hoops 46 and 50 of the left and right lines 44 and 48 to apply pressure to areas adjacent to the equine's ears. The pressure will cause the equine to follow the lead and direction of the trainer or rider holding the reins. Once the reins are released the recoil mechanism pulls the left hoop 46 and right hoop 50 away from the equine's ears thus removing the pressure applied to the ears.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. An equine halter for controlling the behavior of an equine, the halter comprising:

a noseband for being attached to the equine intermediate the equine's nose and eyes;

a headband having:

an upper surface;

a lower surface in opposed relation to the upper surface;

a left through opening for receiving the equine's left ear therethrough;

a right through opening sufficiently spaced from the left through opening to receive the equine's right ear therethrough;

a central headband portion defined between the left and right through openings with the lower surface of the central headband portion positioned adjacent the top of the equine's head;

a left cheek strap positioned adjacent the equine's left cheek and connected to the noseband; and a right cheek band positioned adjacent the equine's right cheek and connected to the noseband;

a left line attached adjacent the lower surface of the headband and having opposed first and second ends, the first end of the left line having a hoop positioned substantially concentrically about the left through opening of the headband; and a right line attached adjacent the lower surface of the headband and having opposed first and second ends, the first end of the right line having a hoop positioned substantially concentrically about the right through opening of the headband;

wherein movement of the left and right lines downwardly toward the equine's head causes the lines to apply behavior controlling pressure to areas adjacent the equine's ears.

2. The halter of claim 1, further comprising a recoil mechanism attached to the left line.

3. The halter of claim 1, further comprising a recoil mechanism attached to the right line.

4. The halter of claim 1, further comprising a recoil mechanism attached to the hoop of the left line and the hoop of the right line.

5. The halter of claim 1 further comprising a recoil mechanism attached to the central headband portion, the hoop of the left line and the hoop of the right line.

6. The halter of claim 5, wherein the recoil mechanism comprises a resilient band forming a left hoop interlocked with the hoop of the left line and a right hoop interlocked with the hoop of the right line.

7. The halter of claim 1, further comprising a first and second pulley attached to the noseband wherein the left line passes through the first pulley and the right line passes through the second pulley.

8. An equine halter for controlling the behavior of an equine, the halter comprising:

a noseband for being attached to the equine intermediate the equine's nose and eyes;

a headband having:

an upper surface;

a lower surface in opposed relation to the upper surface;

a left through opening for receiving the equine's left ear therethrough;

a right through opening sufficiently spaced from the left through opening to receive the equine's right ear therethrough;

a central headband portion defined between the left and right through openings with the lower surface of the central headband portion positioned adjacent the top of the equine's head;

a left cheek strap positioned adjacent the equine's left cheek and connected to the noseband; and a right cheek band positioned adjacent the equine's right cheek and connected to the noseband;

a left line attached adjacent the lower surface of the headband and having opposed first and second ends, the first end of the left line having a hoop positioned substantially concentrically about the left through opening of the headband;

a right line attached adjacent the lower surface of the headband and having opposed first and second ends, the first end of the right line having a hoop positioned substantially concentrically about the right through opening of the headband; and a resilient band attached to the center headband portion and forming a left hoop interlocked with the hoop of the left line and a right hoop interlocked with the hoop of the right line;

wherein movement of the left and right lines downwardly toward the equine's head causes the lines to apply behavior controlling pressure to areas adjacent the equine's ears.

9. An equine halter for controlling the behavior of an equine, the halter comprising:

a noseband for being attached to the equine intermediate the equine's nose and eyes;

a headband having:

an upper surface;

a lower surface in opposed relation to the upper surface;

a left through opening for receiving the equine's left ear therethrough;

a right through opening sufficiently spaced from the left through opening to receive the equine's right ear therethrough;

a central headband portion defined between the left and right through openings with the lower surface of the central headband portion positioned adjacent the top of the equine's head;

a left cheek strap positioned adjacent the equine's left cheek and connected to the noseband; and a right cheek band positioned adjacent the equine's right cheek and connected to the noseband;

a left line attached adjacent the lower surface of the headband and having opposed first and second ends, the first end of the left line having a hoop positioned substantially concentrically about the left through opening of the headband;

a right line attached adjacent the lower surface of the headband and having opposed first and second ends, the first end of the right line having a hoop positioned substantially concentrically about the right through opening of the headband; and a first and second pulley attached to the noseband wherein the left line passes through the first pulley and the right line passes through the second pulley;

wherein movement of the left and right lines downwardly toward the equine's head causes the lines to apply behavior controlling pressure to areas adjacent the equine's ears.

* * * * *